US006539936B2

(12) United States Patent
Behn

(10) Patent No.: US 6,539,936 B2
(45) Date of Patent: Apr. 1, 2003

(54) FIREPLACE AND DECORATIVE REMOVABLE COVER THEREFOR

(76) Inventor: Andrea Sharon Behn, 1311 Ridge Rd., Longwood, FL (US) 32750

( * ) Notice: Subject to any disclaimer, the term of this patent is extended or adjusted under 35 U.S.C. 154(b) by 0 days.

(21) Appl. No.: 10/146,319

(22) Filed: May 15, 2002

(65) Prior Publication Data

US 2002/0170554 A1 Nov. 21, 2002

Related U.S. Application Data

(60) Provisional application No. 60/290,821, filed on May 15, 2001.

(51) Int. Cl.[7] ..... F24B 1/192

(52) U.S. Cl. ..... 126/547; 126/545; 126/552; 49/463; 49/465

(58) Field of Search ..... 126/544–551, 126/500, 552; 49/463, 465, 466, 478.1, 490.1, 507; 160/351, DIG. 9; D23/405, 406

(56) References Cited

U.S. PATENT DOCUMENTS

| | | | | |
|---|---|---|---|---|
| 58,146 A | | 9/1866 | Smith | |
| D25,420 S | | 4/1896 | Fitch | |
| D35,383 S | | 12/1901 | Schoonmaker | |
| 972,636 A | | 10/1910 | Pafford | |
| 2,031,732 A | | 2/1936 | Plym | 126/298 |
| 2,398,240 A | | 4/1946 | Merryweather et al. | 126/140 |
| D178,132 S | | 6/1956 | Love | D81/5 |
| 2,941,591 A | * | 6/1960 | Meyer | 126/551 |
| D206,473 S | | 12/1966 | Volz | D81/5 |
| 3,736,024 A | | 5/1973 | Woolard | 297/217 |
| 3,789,825 A | | 2/1974 | Reiner | 126/140 |
| 3,894,527 A | | 7/1975 | Ickes | 126/140 |
| 3,921,619 A | | 11/1975 | Barriball | 126/140 |
| 4,010,730 A | | 3/1977 | Mitchell | 126/140 |
| 4,084,570 A | | 4/1978 | Rule et al. | 126/140 |
| 4,102,321 A | | 7/1978 | Githens | 126/140 |
| 4,108,145 A | | 8/1978 | Klomser et al. | 126/140 |
| 4,154,217 A | | 5/1979 | Buckner | 126/140 |
| 4,160,442 A | | 7/1979 | Fox et al. | 126/140 |
| 4,183,348 A | | 1/1980 | Smith | 126/140 |
| 4,236,499 A | | 12/1980 | Simeone | 126/140 |
| 4,245,614 A | | 1/1981 | Hurwitz et al. | 126/202 |
| 4,495,933 A | | 1/1985 | Schinbeckler | 126/123 |
| 5,301,655 A | | 4/1994 | Licata | 126/547 |
| D396,001 S | | 7/1998 | Crumpler | D23/406 |
| 6,073,625 A | | 6/2000 | Ball | 126/547 |
| D439,642 S | | 3/2001 | French et al. | D23/350 |
| 6,314,191 B1 | | 11/2001 | Smith | 381/160 |

* cited by examiner

*Primary Examiner*—James C. Yeung
(74) *Attorney, Agent, or Firm*—Allen, Dyer, Doppelt, Milbrath & Gilchrist, P.A.

(57) ABSTRACT

A combination of a fireplace and a decorative removable cover therefor is provided. The fireplace may include an enclosure having a front access opening and a frame positioned within the front access opening. Further, the decorative removable cover may include an opaque substrate and decorative indicia thereon. The opaque substrate may have a size and shape to be received within the front access opening of the fireplace. The cover may also include at least one fastener for removably attaching the opaque substrate to the frame within the front access opening of the fireplace for display of the decorative indicia.

20 Claims, 2 Drawing Sheets

FIREPLACE AND DECORATIVE REMOVABLE COVER THEREFOR

RELATED APPLICATION

This application is based upon prior filed copending provisional application Serial No. 60/290,821 filed May 15, 2001, the entire subject matter of which is incorporated herein by reference in its entirety.

FIELD OF THE INVENTION

The present invention relates to the field of fireplaces, and, more particularly, to fireplace covers and related methods.

BACKGROUND OF THE INVENTION

Fireplaces have long been used as a source for heat and light in houses. Even though most homes these days have electricity, many homes still have fireplaces to provide a supplemental source of heat and, even more importantly, an intimate and decorative addition to the house. Of course, given that fireplaces are a source of heat, they are typically not used during the hotter months of the year. As such, fireplace covers are sometimes used to provide an alternate source of decoration in homes when the natural beauty of a fire is not practical.

One example of a prior art summer cover or front for a fireplace is illustrated in U.S. Pat. No. Des. 206,473 to Volz, which includes a rectangular cover with a design on the front and a stand for holding the cover upright in front of a fireplace opening. Other examples of fireplace fronts are illustratively shown in U.S. Pat. Nos. Des. 25,240 to Fitch and U.S. Pat. No. Des. 35,383 to Schoonmaker. A more utilitarian example of a fireplace cover is disclosed in U.S. Pat. No. 3,736,024 to Woolard. This patent is directed to a combination fireplace cover and article of furniture (e.g., a chair or couch) that is used for hiding the opening of a fireplace when it is not in use.

Another useful feature of fireplace covers is that they may be used to close or seal a fireplace to reduce drafts of cold air from entering a house through the fireplace when it is not in use. Conversely, such covers may be used to keep cool air from escaping out through the fireplace when the house is being air conditioned. One example of a fireplace draft guard is illustrated in U.S. Pat. No. Des. 396,001 to Crumpler, which has a picture of a fireplace with burning logs on the front.

Another example is disclosed in U.S. Pat. No. 3,789,825 to Reiner. This patent discloses a closure device for sealing a fireplace opening over the hearth of a fireplace when it is not in use. The device includes a cover member with sealing material along the bottom, side and top edges of the back of the cover member. Furthermore, a pair of "J" shaped springs are mounted on the on the back by a height adjusting mechanism. The cover device has an area greater than an area of the fireplace opening, and the springs thus frictionally engage the roof of the fireplace to hold the cover member over the opening of the fireplace. Also, the front of the device may be burnished or have a design thereon. Further examples of fireplace cover/closure devices may be found in U.S. Pat. No. 5,301,655 to Licata and U.S. Pat. No. 6,073,625 to Ball.

One difficulty in using certain of the above fireplace covers is that their size and stands/mounting hardware may make them relatively heavy and bulky. As a result, it may be cumbersome to move and store such fireplace covers.

Further, a cover that is placed in front of the fireplace may not be ideal for a household with small children, for example, or may otherwise get in the way when one is entertaining or performing household functions around the fireplace.

SUMMARY OF THE INVENTION

In view of the foregoing background, it is therefore an object of the present invention to provide a combination fireplace and cover therefor that is both aesthetically pleasing and easy to use and store.

This and other objects, features, and advantages in accordance with the present invention are provided by a combination of a fireplace and a decorative removable cover therefor. The fireplace may include an enclosure having a front access opening and a frame (e.g., a screen frame) positioned within the front access opening. Further, the decorative removable cover may include an opaque substrate and decorative indicia thereon. The opaque substrate may have a size and shape to be received in the front access opening of the fireplace. The cover may also include at least one fastener for removably attaching the opaque substrate to the frame within the front access opening of the fireplace for display of the decorative indicia. Accordingly, the decorative removable cover is not only aesthetically pleasing and easy to mount, but it is also conveniently located within the fireplace opening to be out of the way of children, guests, etc.

More particularly, the screen frame may further include spaced apart top and bottom channels, and the at least one fastener may removably secure the opaque substrate to the top and bottom channels. Moreover, the top and bottom channels may each be a U-shaped channel, and the opaque substrate may be received in the U-shaped top and bottom channels. In addition, the frame may also include side channels connected to the top and bottom channels.

The at least one fastener may include at least one hook and loop fastener and/or at least one magnet, for example. Further, the frame may have at least one opening therein, and in such embodiments the at least one fastener may be removably positioned in the at least one opening. The opaque substrate may be wood, a foam board, or other suitable materials, for example. In some embodiments, the fireplace may further include a screen carried by the frame.

A method aspect of the invention is for covering a fireplace including an enclosure having a front access opening and a frame positioned within the front access opening. The method may include positioning a decorative removable cover in the front access opening of the fireplace. As briefly described above, the decorative removable cover may include an opaque substrate with decorative indicia thereon. The method may also include removably attaching the opaque substrate to the frame within the front access opening of the fireplace using at least one fastener for display of the decorative indicia.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation are used to indicate similar elements in alternative embodiments.

Figure 1:
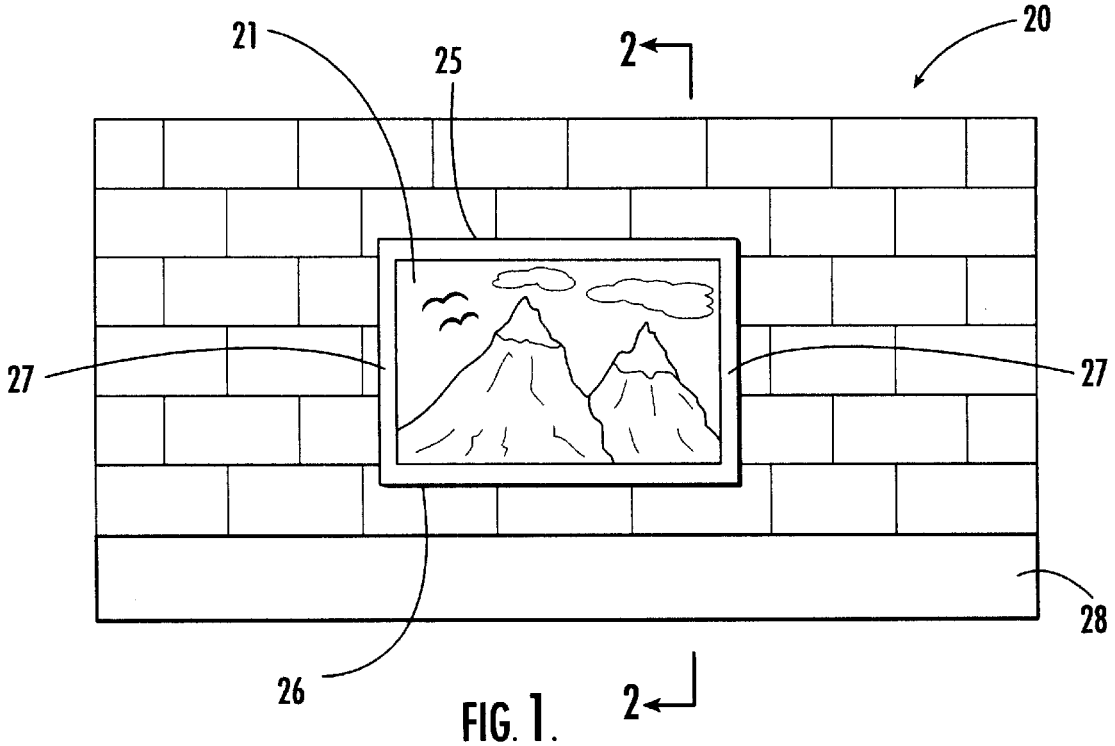
FIG. 1 is front view of a combination fireplace and decorative removable cover therefor in accordance with the present invention.
Figure 2:
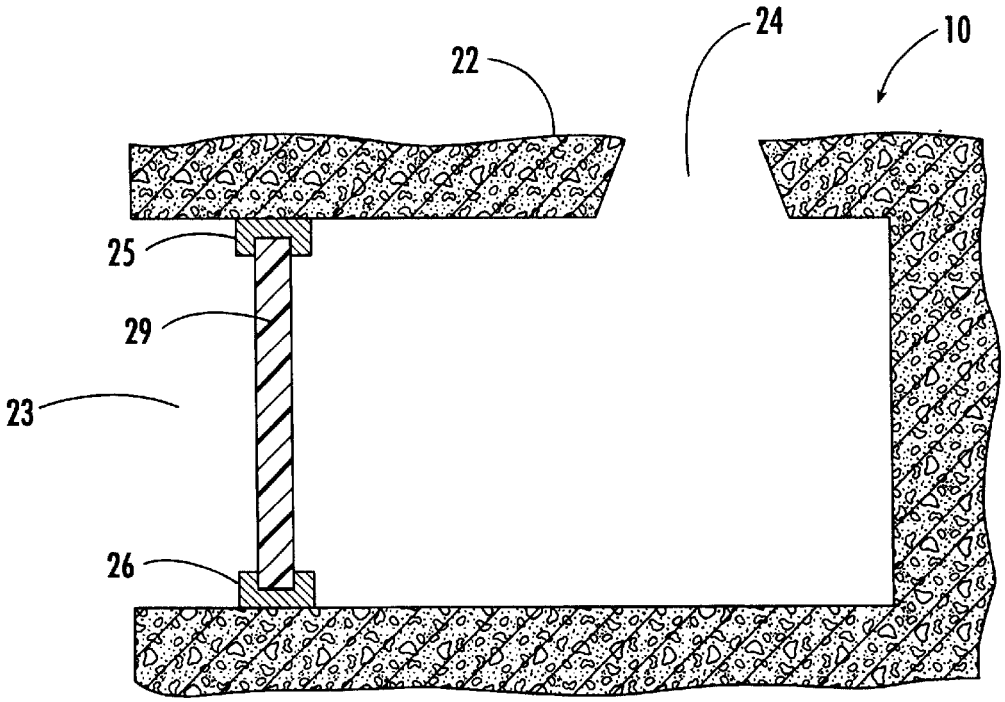
FIG. 2 is a cross-sectional view of the fireplace and cover of FIG. 1 taken along line 2—2.

Referring initially to FIGS. 1 and 2, a combination of a fireplace 20 and a decorative removable cover 21 therefor in accordance with the invention is now described. The fireplace 20 illustratively includes an enclosure 22 having a front access opening 23 and a flue opening 24 to allow smoke from the fireplace to be vented outside via a chimney (not shown), for example. The fireplace 20 also illustratively includes a hearth 28, though a hearth is not required in all embodiments.

In addition, the fireplace 20 further includes a frame, such as for a fireplace screen 40' (FIG. 4) or glass doors (not shown), positioned within the front access opening. The fireplace screen 40' is typically a metal or wire mesh screen used to keep embers and/or other burning debris within the enclosure 22. In the illustrated embodiment, the frame includes spaced apart top and bottom U-shaped channels 25, 26, respectively, as well as spaced apart side channels 27 connected to the top and bottom channels. The side channels 27 may also be U-shaped channels, but they need not be.

It will be appreciated by those of skill in the art that different numbers of frame channels may be used in different embodiments. For example, some embodiments may only include the top and bottom channels 25, 26, or only the top channel. The U-shaped channels are well suited for use with sliding fireplace screens 40' that can be moved to either side of the fireplace to allow access to the fire therein, as will be understood by those of skill in the art. Other channel shapes are also possible, and other types of screen frames, such as one including a rod at the top thereof for a sliding fireplace screen, may also be used.

The decorative removable cover 21 preferably includes an opaque substrate 29 and decorative indicia thereon, as may be seen in FIG. 1. The indicia may be any type of painting, photograph, drawing, mosaic, etc., and it may be placed on the cover by any suitable method known to those of skill in the art. By way of example, the indicia may be painted, screen printed, laser printed, etc. onto the opaque substrate 29. Alternatively, lithographs may be glued or laminated onto the opaque substrate 29. In the case of a mosaic, materials such as glass, fabric, etc. may be attached to the opaque substrate 29 to form a particular design.

The opaque substrate preferably has a size and shape to be received within the front access opening 23 of the fireplace 20. Of course, the cover 21 may come in a variety of widths, heights, and shapes to accommodate numerous fireplace access openings 23. By way of example, the opaque substrate 29 may be made out of wood, foam board, and/or other suitable materials. In the case of foam board, for example, the shape and/or size of the cover 21 may be relatively easily altered by a user for his particular fireplace either by having segmented portions that can be broken off (not shown), or by use of a razor or knife, as will be understood by those of skill in the art.

It should be noted here that the above described materials are intended for use only when the fireplace 20 is not in use and no fire or smoldering objects are present therein. That is, the cover 21 is primarily intended to be used when the fireplace 20 is not in use, which could be in hotter months or other times of the year as well. Of course, fireproof material may be used in some embodiments, if desired, but it is generally not recommended that the cover 21 be placed in the front access opening 23 when the fireplace 20 is in use.

In the embodiment illustrated in FIGS. 1 and 2, the cover 21 is removably positioned or received within the top and bottom U-shaped channels 25, 26 so that the decorative indicia is displayed in the front access opening 23. That is, the top and bottom channels 25, 26 (and, optionally, side channels 27) securely hold the cover 21 in an upright position within the front access opening 23. In other embodiments, the cover 21 may include one or more fasteners for removably attaching the opaque substrate 29 to the frame within the front access opening 23 of the fireplace 20 for display of the decorative indicia.

Figure 3:
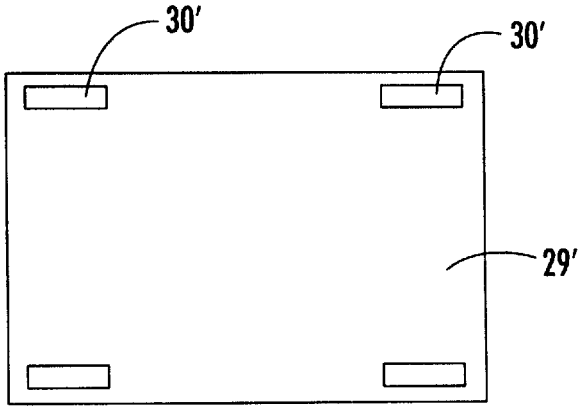
FIG. 3 is a rear view of an alternate embodiment of the cover of FIG. 1.
Figure 4:
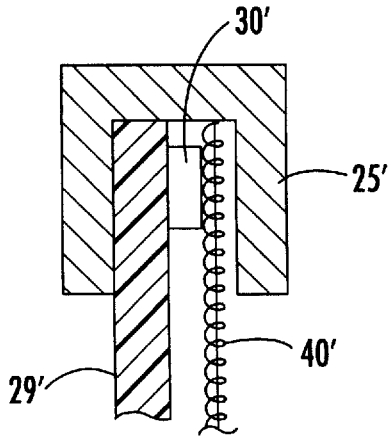
FIG. 4 is a cross-sectional view of a corner portion of the cover of FIG. 3 removably secured to a U-shaped fireplace screen frame channel.

For example, turning to the embodiment illustrated in FIGS. 3–4, the fasteners here are magnets 30', which may be used for attachment to a metal frame, as will be appreciated by those of skill in the art. As illustratively shown, the magnets 30' are strips of magnetic tape that can be secured to the opaque substrate 29' with an adhesive backing, but other types or shapes of magnets may also be used. Furthermore, more or less magnetic tape may be used than that which is illustratively shown in various embodiments.

It may also be seen with reference to FIG. 4 that in those embodiments in which the fireplace 20 includes a screen frame and screen 40' carried thereby, the opaque substrate 29' may advantageously be sized such that it fits in the screen frame with the screen. The same may also be true for glass door frames, or frames that include both doors and a screen. For those embodiments including a metal screen 40', the magnets 30' are a good choice of fastener because they similarly provide removable attachment to the metal screen.

Figure 5:
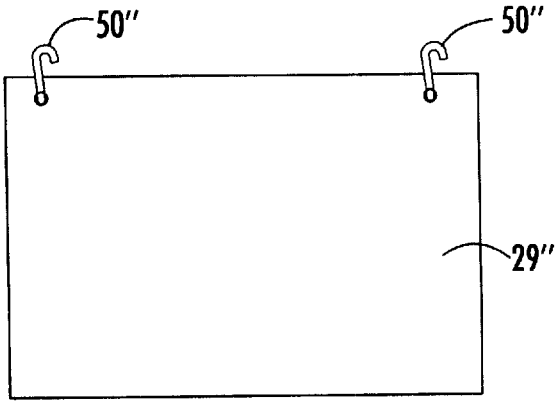
FIG. 5 is a rear view of another alternate embodiment of the cover of FIG. 1.
Figure 6:
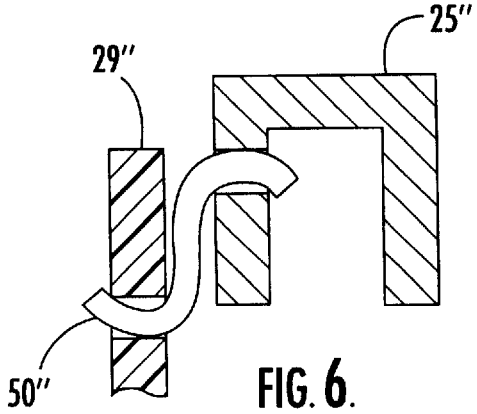
FIG. 6 is a cross-sectional view of a corner portion of the cover of FIG. 5 removably secured to a U-shaped fireplace screen frame channel.

In another embodiment illustrated in FIGS. 5–6, the frame, and particularly the top channel 25", may have one or more openings therein. In this embodiment, a hook-type fastener 50", such as an "S" hook, may be positioned in one more of the openings in the frame and also attached to the cover 21 for removably positioning the cover within the front access opening 23. For an S hook, the other end of the hook may be positioned in a corresponding opening in the opaque substrate 29", as illustratively shown. Of course, other suitable hangers may also be used, one particular example of which is commonly referred to as a foam board hanger.

Figure 7:
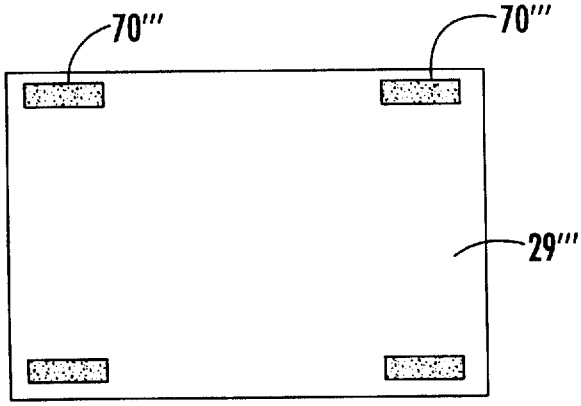
FIG. 7 is a rear view of yet another alternate embodiment of the cover of FIG. 1.
Figure 8:
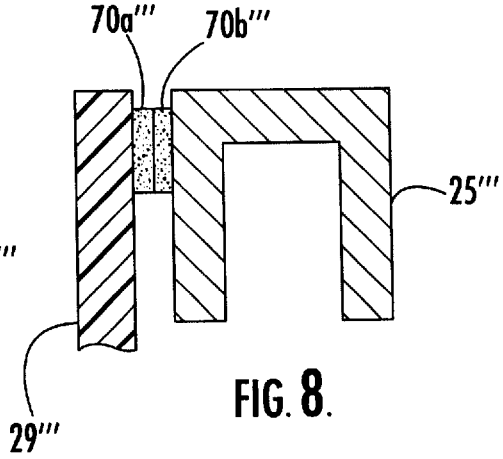
FIG. 8 is a cross-sectional view of a corner portion of the cover of FIG. 7 removably secured to a U-shaped fireplace screen frame channel.

Another embodiment is illustrated in FIGS. 7–8. Here, the fasteners may be hook and loop type fasteners 70'" (e.g., VELCRO®). As with the above described magnets 30', the hook and loop fasteners may be of various length and placed at one or more locations adjacent the periphery of the back of the opaque substrate 29'" corresponding to certain portions of the screen frame. As will be understood by those skilled in the art, these fasteners may include first and second mating portions 70*a*'''', 70*b*'''' which engage one another when pressed together. Adhesive backing may be used to secure the first and second portions 70*a*'''', 70*b*'''' to the opaque substrate 29'''' and top channel 25'''', for example. Of course, other suitable fasteners known to those of skill in the art may also be used in other embodiments. Further, it may be desirable to remove the second portion or portions 70*b*'''' from the screen frame before using the fireplace 20.

It will therefore be appreciated by those of skill in the art the decorative cover 21 provides an aesthetically pleasing addition to any suitable fireplace 20 that is relatively easy and convenient to position therein. Moreover, because the cover 21 fits within the front access opening 23, it is out of the way of children who may play around the fireplace 20, etc., and less susceptible to being knocked over or damaged. It should also be noted that in some embodiments the cover 21 may also include a seal (e.g., foam, rubber, etc.) on the back thereof to contact the frame and thus help reduce drafts, as will be understood by those skilled in the art.

A method aspect of the invention is for covering a fireplace 20 including an enclosure 22 having a front access opening 23 and a screen frame positioned within the front access opening. The method may include positioning a decorative removable cover 21, as described above, in the front access opening 23 of the fireplace 20. The method may also include removably attaching the opaque substrate 29, 29', 29'', 29'''' to the screen frame within the front access opening 23 of the fireplace 20 using at least one fastener 30', 40'', 50'''' so that the decorative indicia is displayed in the front access opening. Other method aspects of the invention will be apparent to those of skill in the art based upon the above description and will therefore not be discussed further herein.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A combination of a fireplace and a decorative removable cover therefor;

said fireplace comprising an enclosure having a front access opening, and a frame positioned within the front access opening;

said decorative removable cover comprising an opaque substrate and decorative indicia thereon, said opaque substrate having a size and shape to be received within the front access opening of said fireplace; and at least one fastener for removably attaching said opaque substrate to said frame within the front access opening of said fireplace for display of the decorative indicia.

2. The fireplace and cover of claim 1 wherein said frame comprises spaced apart top and bottom channels; and wherein said at least one fastener removably secures said opaque substrate to said top and bottom channels.

3. The fireplace and cover of claim 2 wherein said top and bottom channels each comprise a U-shaped channel.

4. The fireplace and cover of claim 3 wherein said opaque substrate is received in said U-shaped top and bottom channels.

5. The fireplace and cover of claim 2 wherein said frame further comprises side channels connected to said top and bottom channels.

6. The fireplace and cover of claim 1 wherein said at least one fastener comprises at least one hook and loop fastener.

7. The fireplace and cover of claim 1 wherein said at least one fastener comprises at least one magnet.

8. The fireplace and cover of claim 1 wherein said frame has at least one opening therein; and wherein said at least one fastener is removably positioned in the at least one opening.

9. The fireplace and cover of claim 1 wherein said opaque substrate comprises wood.

10. The fireplace and cover of claim 1 wherein said opaque substrate comprises a foam board.

11. The fireplace and cover of claim 1 wherein said frame comprises a screen frame; and wherein said fireplace further comprises a screen carried by said screen frame.

12. A combination of a fireplace and a decorative removable cover therefor;

said fireplace comprising an enclosure having a front access opening, a screen frame positioned within the front access opening, said screen frame comprising top and bottom U-shaped channels, and a screen carried by said fireplace screen frame;

said decorative removable cover comprising an opaque substrate and decorative indicia thereon, said opaque substrate having a predetermined size and shape to be removably positioned within the top and bottom U-shaped channels of said screen frame for display of the decorative indicia.

13. The fireplace and cover of claim 12 wherein said decorative cover further comprises at least one fastener for removably securing said opaque substrate within the top and bottom U-shaped channels of said screen frame.

14. The fireplace and cover of claim 12 wherein said at least one fastener comprises at least one magnet.

15. The fireplace and cover of claim 12 wherein said fireplace screen frame has at least one opening therein; and wherein said at least one fastener is removably positioned in the at least one opening.

16. The fireplace and cover of claim 12 wherein said opaque substrate comprises wood.

17. The fireplace and cover of claim 12 wherein said opaque substrate comprises a foam board.

18. A method for covering a fireplace comprising an enclosure having a front access opening and a frame positioned within the front access opening, the method comprising:

positioning a decorative removable cover in the front access opening of the fireplace, the decorative removable cover comprising an opaque substrate and decorative indicia thereon; and removably attaching the opaque substrate to the frame within the front access opening of the fireplace using at least one fastener for display of the decorative indicia.

19. The method of claim 18 wherein the frame comprises spaced apart top and bottom channels; and wherein removably attaching comprises removably securing the opaque substrate to the top and bottom channels using the at least one fastener.

20. The method of claim 18 wherein the at least one fastener comprises at least one of a hook and loop fastener and a magnet.

* * * * *